United States Patent [19]

Tabuchi et al.

[11] Patent Number: 4,862,221

[45] Date of Patent: Aug. 29, 1989

[54] CLEANING DEVICE

[75] Inventors: Kenji Tabuchi; Tomohisa Kanada, both of Osaka, Japan

[73] Assignee: Minolta Camera Kabushiki Kaisha, Osaka, Japan

[21] Appl. No.: 198,928

[22] Filed: May 24, 1988

[30] Foreign Application Priority Data

May 27, 1987 [JP] Japan ..... 62-130270

[51] Int. Cl.[4] ..... G03G 21/00

[52] U.S. Cl. ..... 355/300; 118/652; 15/256.5

[58] Field of Search ..... 355/15, 3 R; 15/256.5, 15/256.51; 118/652

[56] References Cited

U.S. PATENT DOCUMENTS

| | | | |
|---|---|---|---|
| 352,331 | 8/1870 | Stoever | 15/256.5 X |
| 3,067,720 | 12/1962 | Lewis et al. | 118/308 |
| 3,099,856 | 8/1963 | Eichorn et al. | 355/15 X |
| 3,598,488 | 8/1971 | Di Francesco | 355/15 |
| 3,624,858 | 12/1971 | Dimond et al. | 15/256.5 |
| 3,625,605 | 12/1971 | Schnall | 355/15 |
| 3,672,764 | 6/1972 | Hartwig et al. | 355/15 |
| 3,712,734 | 1/1973 | Jovanovic | 355/15 |
| 3,740,864 | 6/1973 | Ito et al. | 355/15 |
| 3,792,925 | 2/1974 | Milligan et al. | 355/15 |
| 3,975,096 | 8/1976 | Opravil | 355/15 |
| 4,110,035 | 8/1978 | Kamata | 355/15 |
| 4,369,456 | 1/1983 | Cruz-Uribe | 346/140 R |
| 4,650,311 | 3/1987 | Mayer | 355/15 |

FOREIGN PATENT DOCUMENTS

| | | |
|---|---|---|
| 60-80890 | 5/1985 | Japan . |

*Primary Examiner*—R. L. Moses

[57] ABSTRACT

A cleaning device comprising a cleaning web with a concave-convex pattern. The concave-convex pattern is constituted by a plurality of concave or convex portions arranged in cross stripe manner.

18 Claims, 3 Drawing Sheets

CLEANING DEVICE

BACKGROUND OF THE INVENTION

1. Field of the Invention:

The present invention relates to a cleaning device for cleaning the surface of an electrostatic latent image bearing member for use in a copying machine, printer or the like.

2. Description of the Prior Arts:

Conventional copying machines, printers or the like comprising an electrophotographic copy process have adapted a construction wherein residual toner particles or paper fragments remaining on the surface of a photosensitive drum are scraped off from the drum by a blade after a toner image formed on the surface of the drum is transferred onto a sheet.

Although toner particles or fiber components included in paper fragments can be removed by the blade, filling materials such as talc, calcium carbonate or the like having a diameter smaller than that of toner particles and contained in a sheet slip through the portion between the leading end of the blade and the photosensitive drum while coated on the surface of the drum due to the pressing power of the blade, producing a filming phenomenon. When this filming becomes thick, the surface potential of the photosensitive drum cannot be reduced upon the exposure of an image, causing deterioration of the image quality such as white-outs, slenderized character, deficiency of lines or the like.

On the other hand, there has been proposed a cleaning device which is different from a blade type device and employs a web. This web cleaning device is adapted to continuously or stepwisely feed a web material from a roller into pressing contact with the surface of the drum while taking up the web material by another roller, said device disclosed, for example, in U.S. Pat. No. 3,067,720.

However, in the above-mentioned web cleaning device, increased pressing power of the roller for completely removing the filming phenomenon increases rotating load of the photosensitive drum, causing the problem that a great load is imposed on the driving mechanism of the photosensitive drum.

SUMMARY OF THE INVENTION

The main object of the present invention is to provide an improved cleaning device.

Another object of the invention is to provide a cleaning device capable of cleaning the surface of a photosensitive drum without imposing a great pressing power.

The present invention is achieved by a web cleaning device wherein a cleaning web has a concave-convex pattern arranged in cross stripe manner.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

A preferred embodiment according to the present invention will be explained hereinbelow with reference to the drawings.

Figure 1:
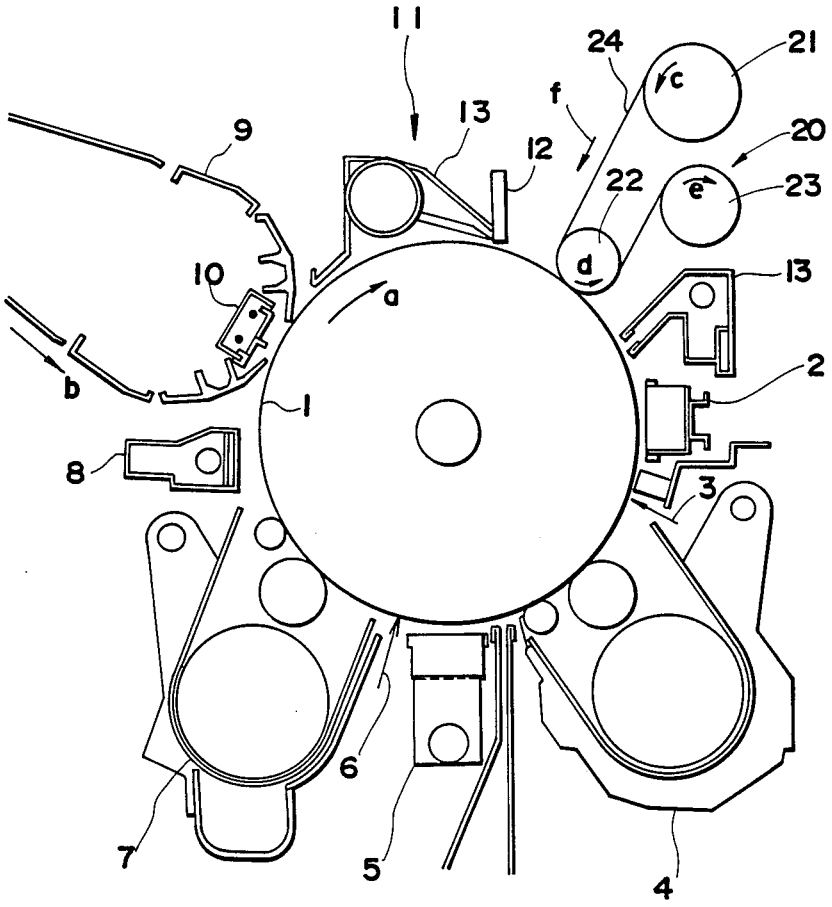
FIG. 1 is a fragmentary view in section schematically showing a two-color printer employing a cleaning device of the present invention.
Figure 2:
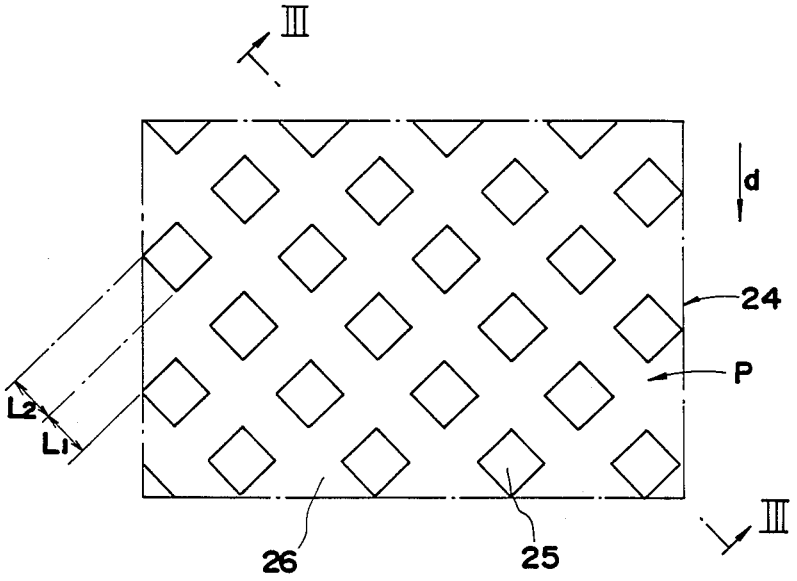
FIG. 2 is a plan view partly showing a concave-convex pattern.
Figure 3:
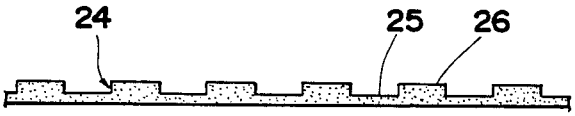
FIG. 3 a sectional view of the concave-convex pattern taken along/line III—III of FIG. 2.
Figure 4:
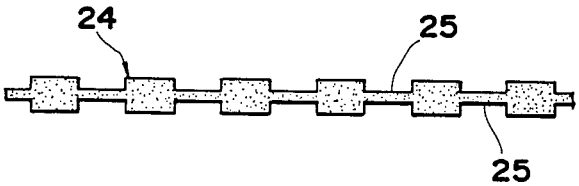
FIG. 4 is a sectional view showing another embodiment of the present invention.

FIG. 1 shows a fragmentary sectional view of a two-color printer provided with a cleaning device embodying the present invention.

The two-color printer comprises a photosensitive drum 1 rotatably provided. With the drum 1 rotating in the direction of an arrow a shown in FIG. 1, a toner image having a second color is formed by a second charger 5, second exposure 6 and second developing device 7 after the formation of a toner image having a first color by a first charger 2, first exposure 3 and first developing device 4. Thereafter, a surface potential is reduced by a pre-transfer eraser 8.

The toner images are transferred at the opposite portion to a transfer charger 10 onto a copy paper (not shown) transported from the direction shown by an arrow b by a tractor 9.

On the other hand, toner fragments, paper particles and the like remaining on the surface of the photosensitive drum 1 are scraped off by a first cleaner 11 which comprises a blade 12 and a collecting device 13. Specifically, remaining particles are scraped off by the blade 12 and then collected in the collecting device 13 by air suction.

Subsequently, fine particles such as talc remaining on the surface of the photosensitive drum 1 is cleaned by a second cleaner 20. Residual charges on the drum 1 are erased by an eraser 13.

Next, the second cleaning device 20 embodying the present invention will be explained.

The second cleaning device 20 comprises a feed roller 21 provided parallel to the photosensitive drum 1, a web roller 22, a take-up roller 23 and a paper web 24.

The web roller 22, which is formed of elastic material, presses down the paper web 24 on the surface of the photosensitive drum 1 at a predetermined amount of power.

The paper web 24 is wound around the feed roller 21, the leading end of which is fixed through the web roller 22 to the take-up roller 23 rotatably driven in the direction of an arrow e.

Moreover, the paper web 24 is formed of a material having a predetermined thickness such as nonwoven fabrics, and provided with a concave-convex pattern P by emboss process at the surface where the photosensitive drum 1 is in contact therewith.

Concave portions 25 of the concave-convex pattern P, which are formed into a square shape, are arranged in cross stripe at an angle of 45° relative to the feeding direction shown by an arrow d. The concave portions 25 may be formed not only on the surface of the paper web 24 with which the photosensitive drum 1 is in contact but also on the underside thereof.

Specifically, the cleaning device 20 is set as follows under the condition of the peripheral speed of the drum 1 being 170 mm/sec.

| | |
|---|---|
| width of concave and convex portions 25 and 26 | $L_1 = L_2 = 1$ mm |
| thickness of the paper web 24 | 0.2–0.4 mm |
| external diameter of the web roller 22 | 25 mm |
| pressing power of the web roller 22 | 5–10 g/mm |
| speed for feeding the paper web | 3–5 cm/hr |

In the cleaning device 20 of the aforesaid structure, the take-up roller 23 is rotatably driven in the direction of the arrow e based on the rotation of the drum 1, thereby feeding the paper web 24 in the direction shown by an arrow f at the above-mentioned speed. The web roller 22 and the feed roller 21 follow to rotate in the direction of arrows d and c respectively.

Then, at the portion where the photosensitive drum 1 is opposed to the web roller 22, the paper web 24 is transported along the direction of rotation of the photosensitive drum 1 while being in pressing contact with the surface of the photosensitive drum 1 at a predetermined nip width based on the deformation of the web roller 22 and paper web 24 due to compression.

By this, the surface of the photosensitive drum 1 is cleaned to eliminate the filming phenomenon.

The cleaning device according to the invention improves the efficiency of scraping and removing toner particles, paper fragments and the like since each concave portion 25 is formed into rectangle shape with its step portion inclined at an angle of 45° relative to the feeding direction shown by the arrow d. There is no need to greatly increase the pressing power of the web roller 22 in order to sufficiently clean the surface of the photosensitive drum 1.

As described above, the paper web 24 is excellent in cleaning ability. Therefore, it has a great effect of scraping even though the web 24 is transported in the same direction as that of the photosensitive drum 1 at the contact portion of the drum. Further, compared with the paper web which is transported in the opposite direction to that of rotation of the photosensitive drum 1, the paper web of the present invention can prevent the torque of the photosensitive drum 1 from increasing as well as prevent the generation of fragments from the paper web 24.

Moreover, the concave portions 25 and convex portions 26 of the concave-convex portion P are arranged in cross stripe relative to the feeding direction and constructed so as to be in contact with the surface of the photosensitive drum 1 at a predetermined nip width with some thickness, the surface of the drum 1 can be uniformly cleaned in the axial direction.

Figure 5:
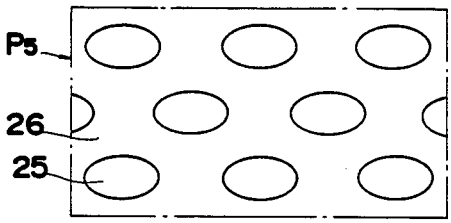
FIGS. 5 to 10 are plan view partly showing another embodiment of the concave-convex pattern.
Figure 6:
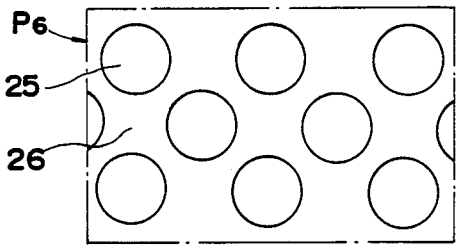
Figure 7:
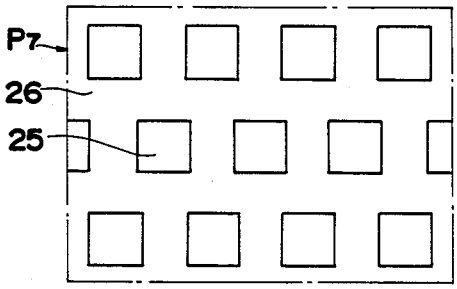
Figure 8:
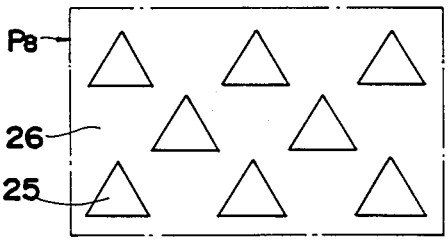
Figure 9:
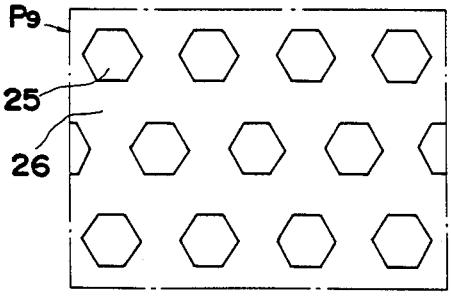
Figure 10:
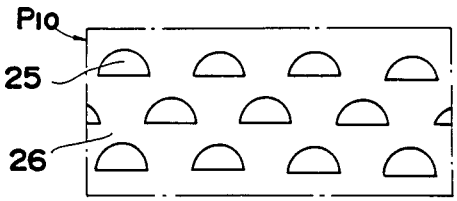

Although the concave-convex pattern P in the above-mentioned embodiment has the concave portions 25 of rectangular shape arranged in cross stripe relative to the feeding direction, various concave-convex pattern may be used such as a pattern $P_5$ having ellipses shown in FIG. 5, $P_6$ having circles shown in FIG. 6, $P_7$ having upright squares shown in FIG. 7, $P_8$ having triangles shown in FIG. 8, $P_9$ having hexagons shown in FIG. 9 and $P_{10}$ having semicircles shown in FIG. 10. These concave-convex patterns $P_5$ to $P_{10}$ may be constructed such that insular portions (square portions, ellipse portions, etc.) is formed as concave portions or as convex portions.

Although the embodiment explained above has two cleaning device, i.e., the first cleaner of blade type and the second cleaner of web type embodying the present invention, it is noted that the web type cleaner of the present invention alone can remove the toner particles and also the filling materials from the surface of the drum.

As apparent from the above, the cleaning device according to the present invention is provided with a concave-convex pattern on the surface of a web cleaning material where an electrostatic latent image bearing member is in contact therewith, the convex portions of said concave-convex pattern being formed so as to be in close contact with the surface of the electrostatic latent image bearing member.

Therefore, the cleaning device of the invention has high cleaning ability of the cleaning material. Further, it exhibits sufficient cleaning ability even though the pressing power of the web roller is reduced or the cleaning material is transported in the same direction as the direction of movement of the electrostatic latent image bearing member at the contact portion of the electrostatic latent image bearing member and the cleaning material.

Accordingly, only a small load is imposed on the driving mechanism of the electrostatic latent image bearing member, assuring stable driving state of the electrostatic latent image bearing member.

Further, the cleaning material produces less amount of fragments, so that the surroundings can be kept clean.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. In electrophotographic recording machines wherein residual toners or the like remaining on an image bearing member are scraped off from the image bearing member by a cleaning device after a toner image formed on the image bearing member is transferred onto a sheet, the cleaning device comprising:

a cleaning web with a regularly formed concave-convex pattern; and means for bringing the cleaning web in pressing contact with the image bearing member.

2. A cleaning device as claimed in claim 1, wherein the cleaning web is a nonwoven fabric being provided with the concave-convex pattern by emboss process.

3. A cleaning device as claimed in claim 1, wherein the concave-convex pattern has a plurality of concave portions arranged in cross stripe manner.

4. A cleaning device as claimed in claim 3, wherein each concave portion has a shape of square.

5. A cleaning device as claimed in claim 4, wherein the concave portions of square shape are disposed with inclining as to the moving direction of the image bearing member.

6. A cleaning device as claimed in claim 3, wherein each concave portion has a shape of ellipse.

7. A cleaning device as claimed in claim 3, wherein each concave portion has a shape of circle.

8. A cleaning device as claimed in claim 3, wherein each concave portion has a shape of triangle.

9. A cleaning device as claimed in claim 3, wherein each concave portion has a shape of hexagon.

10. A cleaning device as claimed in claim 3, wherein each concave portion has a shape of semicircle.

11. A cleaning device as claimed in claim 1, wherein the concave-convex pattern has a plurality of convex portions arranged in cross stripe manner.

12. A cleaning device as claimed in claim 11, wherein each convex portion has a shape of square.

13. A cleaning device as claimed in claim 12, wherein the convex portions of square shape are disposed with inclining as to the moving direction of the image bearing member.

14. A cleaning device as claimed in claim 11, wherein each convex portion has a shape of ellipse.

15. A cleaning device as claimed in claim 11, wherein each convex portion has a shape of circle.

16. A cleaning device as claimed in claim 11, wherein each convex portion has a shape of triangle.

17. A cleaning device as claimed in claim 11, wherein each convex portion has a shape of hexagon.

18. A cleaning device as claimed in claim 11, wherein each convex portion has a shape of semicircle.

* * * * *